US011920463B1

(12) United States Patent
Stair et al.

(10) Patent No.: US 11,920,463 B1
(45) Date of Patent: Mar. 5, 2024

(54) WELLBORE SYSTEM WITH DISSOLVING BALL AND INDEPENDENT PLUG LATCHING PROFILES

(71) Applicant: Citadel Casing Solutions, LLC, Houston, TX (US)

(72) Inventors: Todd Stair, Conroe, TX (US); Phillip Standifer, Spring, TX (US)

(73) Assignee: Citadel Casing Solutions LLC, Houston, TX (US)

( * ) Notice: Subject to any disclaimer, the term of this patent is extended or adjusted under 35 U.S.C. 154(b) by 0 days.

(21) Appl. No.: 17/949,896

(22) Filed: Sep. 21, 2022

(51) Int. Cl.
*E21B 47/06* (2012.01)
*E21B 33/12* (2006.01)

(52) U.S. Cl.
CPC ..... *E21B 47/06* (2013.01); *E21B 33/12* (2013.01)

(58) Field of Classification Search
CPC ..... E21B 47/06; E21B 33/12
See application file for complete search history.

(56) References Cited

U.S. PATENT DOCUMENTS

| | | | | |
|---|---|---|---|---|
| 3,527,297 | A * | 9/1970 | Todd | E21B 34/142 166/318 |
| 5,762,139 | A * | 6/1998 | Sullaway | E21B 33/16 166/291 |
| 11,459,874 | B1 * | 10/2022 | Stair | E21B 33/12 |
| 11,525,331 | B1 * | 12/2022 | Schmidt | E21B 33/12 |
| 11,613,959 | B1 * | 3/2023 | McFarlin | E21B 34/142 166/386 |
| 2013/0112435 | A1 * | 5/2013 | Fleming | E21B 34/14 166/318 |
| 2014/0034310 | A1 * | 2/2014 | Andersen | E21B 23/08 166/281 |
| 2014/0060837 | A1 * | 3/2014 | Love | E21B 43/26 166/325 |
| 2015/0101801 | A1 * | 4/2015 | Budde | E21B 33/14 166/387 |
| 2015/0330181 | A1 * | 11/2015 | Budde | E21B 34/142 166/185 |
| 2020/0263533 | A1 * | 8/2020 | Bruce | E21B 17/07 |
| 2020/0318458 | A1 * | 10/2020 | Godfrey | E21B 23/03 |
| 2020/0332619 | A1 * | 10/2020 | Elliott | E21B 33/12 |

* cited by examiner

*Primary Examiner* — Steven A MacDonald
(74) *Attorney, Agent, or Firm* — Avek IP, LLC

(57) ABSTRACT

A wellbore system includes a first plug and a second plug that latch independently within an elongated housing; at least one plug having an elongated channel with a ball therein for performing operation of a pressure test; and optionally including a ball seat for receiving a dissolving ball for contingency and supplementary casing tests.

4 Claims, 4 Drawing Sheets

WELLBORE SYSTEM WITH DISSOLVING BALL AND INDEPENDENT PLUG LATCHING PROFILES

BACKGROUND

1. Field of the Invention

The present invention relates generally to wellbore shoe track systems, and more specifically, to a wellbore shoe track assembly system for increasing efficiency and bridging a gap between drilling and completions, thereby reducing overall cost and increasing recoverables.

2. Description of Related Art

Wellbore systems are well known in the art and are effective means to collect resources for energy use. FIG. 1 depicts a flowchart 101 of a conventional method of operation, wherein a casing integrity test is performed. The casing integrity test is performed after the casing is cemented in place and typically after the drilling rig has moved offsite and the well is being prepared for completion, as shown with box 103. During operation, the casing integrity test is typically achieved using a hydraulic fracturing pump truck which applies internal pressure to a level in excess of the maximum anticipated operating pressure during the fracking operation. One conventional method is the use of a dissolving ball, wherein the dissolving ball is pumped down to an end of the casing string where it seats on an engineered surface within the string, outside of any plug, in a desired location configured to receive the ball, as shown with boxes 105, 107. The casing integrity test is then performed and the ball is dissolved over a period of several days when the flow path is again open, allowing for injection into the formation, as shown with box 109.

One of the problems commonly associated with method 101 is inefficiency. For example, it would be desirable an advantageous to provide for a system and method wherein the casing integrity test can be performed immediately at the conclusion of cementing that allows toe prep operations. Such a procedure would have the ability to eliminate 12-100 hours of prep time performing the casing integrity test while waiting on dissolution.

Accordingly, although great strides have been made in the area of wellbore systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
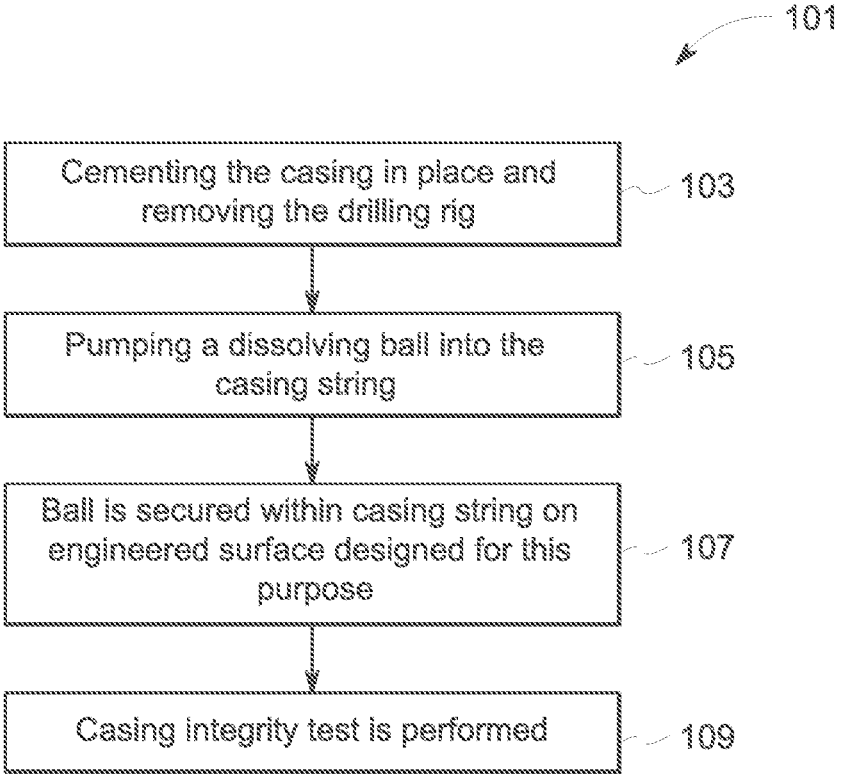
(PRIOR ART) FIG. 1
FIG. 1 is a flowchart of a convention process.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wellbore systems. Specifically, the present invention increases efficiency specifically associated with casing integrity testing during a wellbore operation. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
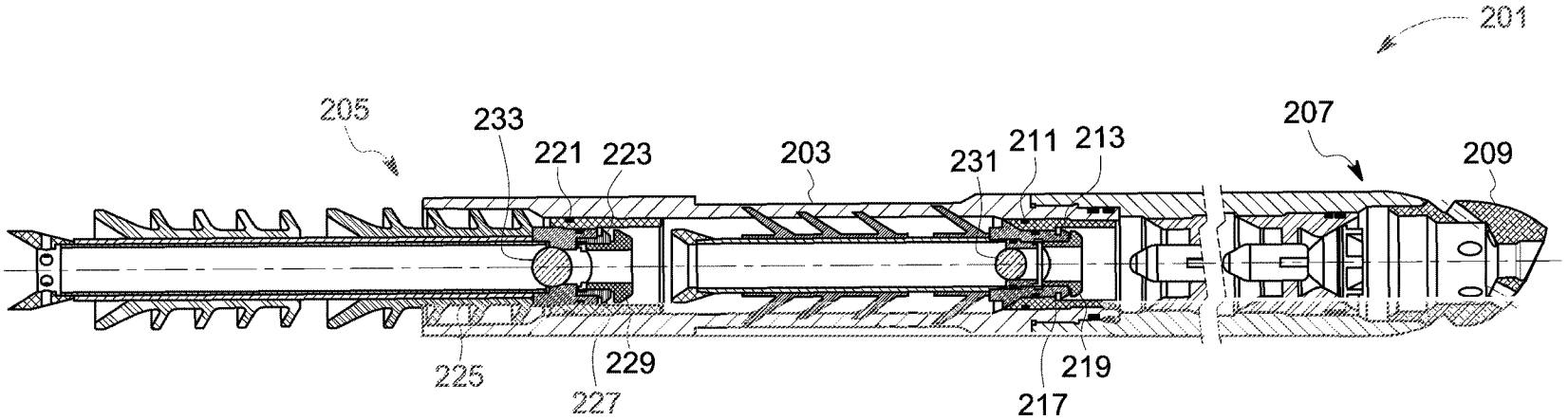
FIG. 2 is a side view of a first embodiment of the system of the present invention.

Referring now to the drawings wherein like reference characters identify corresponding or similar elements throughout the several views, FIG. 2 depicts a side view of a wellbore system 201 in accordance with one embodiment of the present application. Further, FIG. 3A-3E depict side views of another embodiment of the present application. It will be appreciated that system 301 overcomes one or more of the above-listed problems commonly associated with conventional wellbore systems.

In the contemplated embodiment, system 201 includes an elongated housing 203 extending from a first end 205 to a second end 207 and having a guide nose 209 engaged with the second end. In this embodiment, the system includes a first plug seat 211 having a first latch 213 configured to latch a first plug 215 via a first nose 217 of an elongated plug body. The first nose 217 may include protrusions 219 to engage with the first latch as shown.

This embodiment can further include a second plug seat 221 having a second latch 223 and configured to engage with a second plug 225 having a second elongated body and a second nose 227 positioned at an end of the body with protrusions 229 configured to engage with the second latch.

It should be appreciated that one of the unique features believed characteristic of the present application is that the first plug and the second plug latch independently within the elongated housing.

As shown, embodiment 201 may further include a first ball 231 and a second ball 233, wherein each is configured to be dropped into the corresponding plug and travel to the nose of the plug, as will be discussed further herein.

In FIGS. 3A-3E, a plurality of side views depict the configuration of a wellbore system 301 in accordance with the present invention. System 301 utilizes a top plug with a dissolving ball 321 within the plug, which allows for the performance of a casing integrity test immediately at the conclusion of cementing.

Figure 3A:
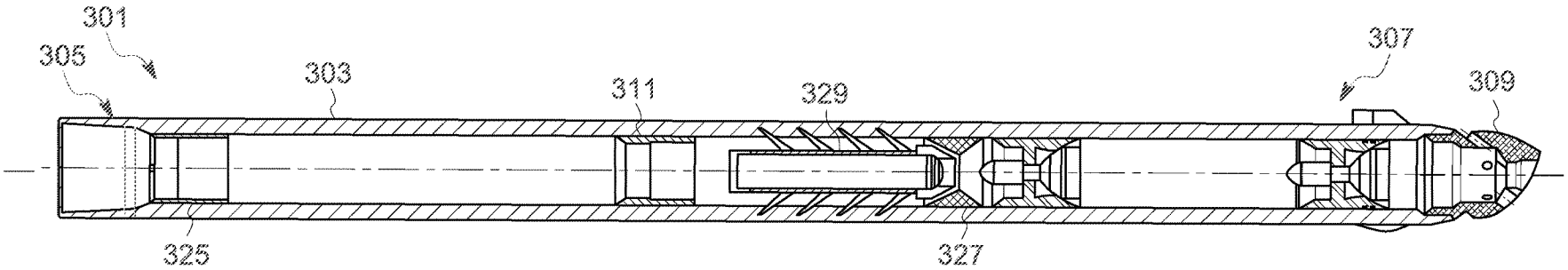
FIGS. 3A-3E are side views showing the process of use of the system of the present invention.
Figure 3B:
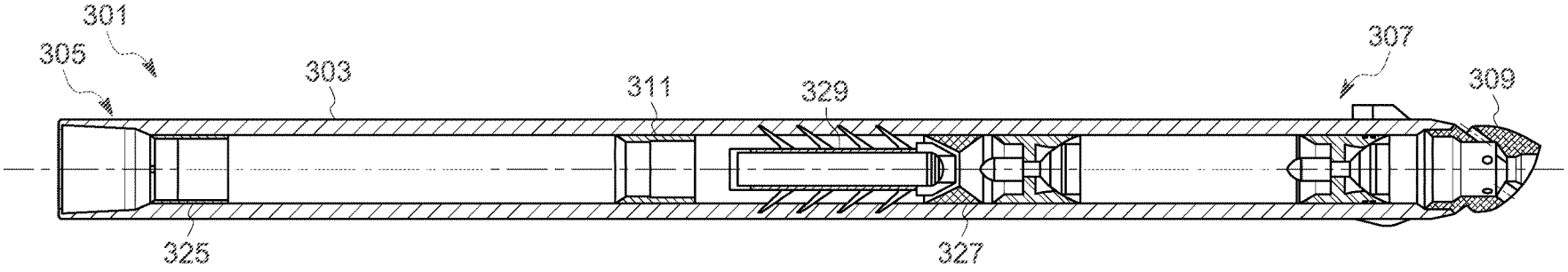
Figure 3C:
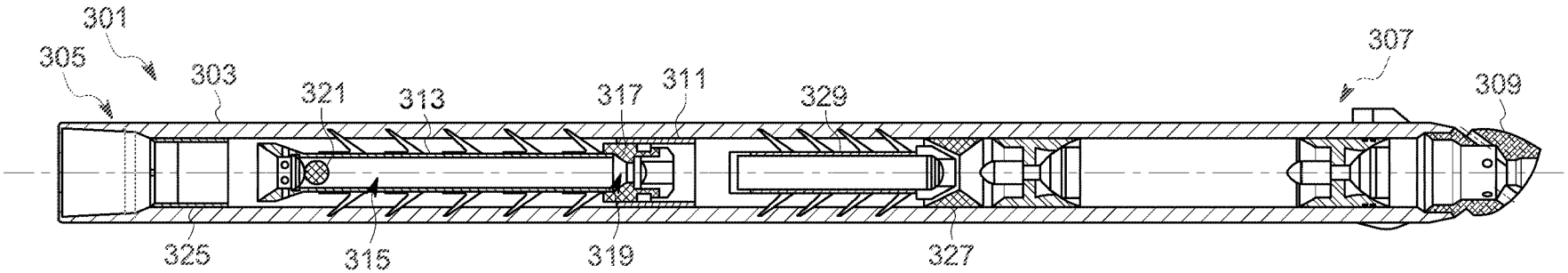
Figure 3D:
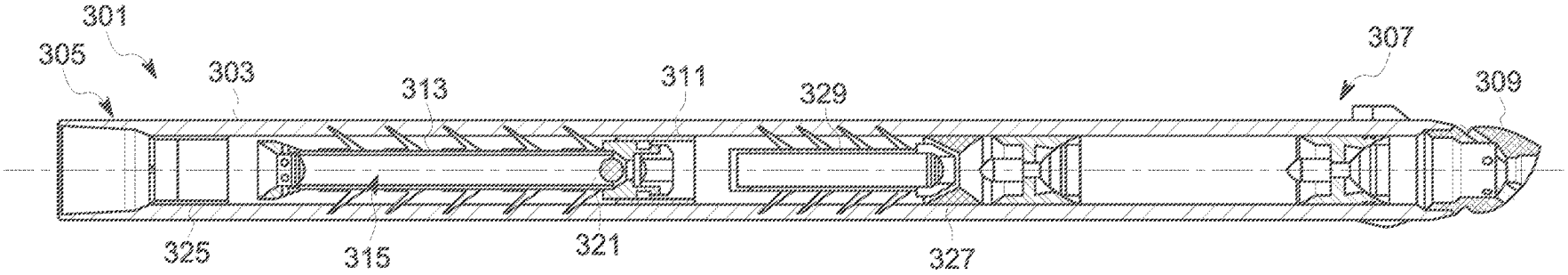
Figure 3E:
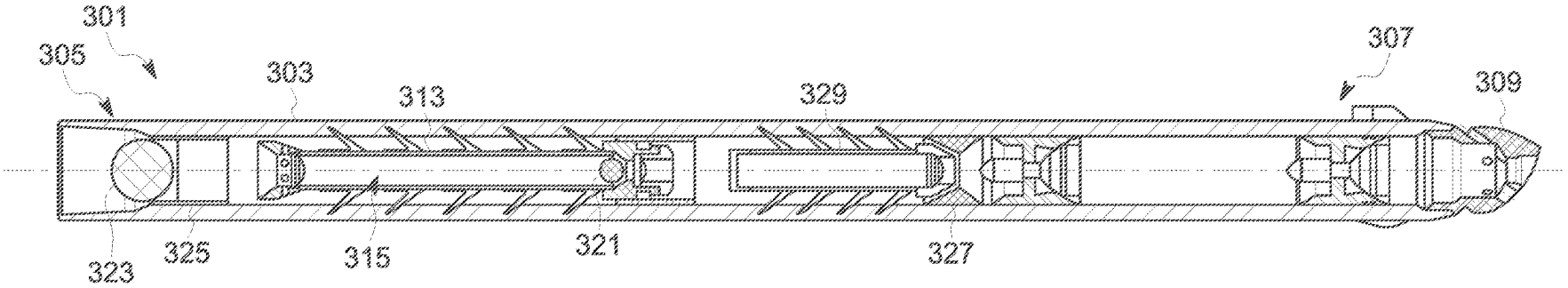

As shown, system 301 includes an elongated housing 303 extending from a first end 305 to a second end 307 and having a guide nose 309 engaged with the second end. A first plug seat 311 is positioned within the elongated housing and configured to receive a first plug 313. The first plug 313 includes an elongated body forming a channel 315 with a first width and a nose 317 positioned at an end of the channel and forming a second width 319. It should be appreciated that the second width is less than the first width. As shown, a ball 321 is carried within the plug from the surface, the ball having a circumference, wherein the circumference is less than the first width and greater than the second width. This feature allows for the ball to travel through the channel of the first plug and rest within proximity to the nose as shown in FIGS. 3C and 3D. As shown, the plug 313 includes burst disks, which when combined with the ball 321, allows for transporting of the plug 313 down hole to enable pressure testing to be performed. The burst disks prevent the ball from coming into contact with fluid such that the ball dissolves.

During use, when the plug 313, along with ball 321, lands in its seat, a casing test can be performed immediately. This feature eliminates the need to drop a ball from the surface.

Embodiment 301 further can include a dissolvable ball 323 configured to be pumped into the elongated housing to rest within a ball seat 325 of the elongated housing.

Embodiment 301 can further include a second plug seat 327 and a second plug 329 configured to engage with the second plug seat.

It should be appreciated that another unique feature believed characteristic of the present application is the use of the dissolving ball within the top plug which enables the casing integrity test to be performed immediately at the conclusion of cementing and enables a clear flow path for completions, significantly reducing toe prep time and expense.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A wellbore system, comprising:

an elongated housing extending from a first end to a second end;

a first plug seat positioned within the elongated housing;

a first plug configured to engage with the first plug seat, the first plug having:

an elongated body forming a channel extending from a top end to a bottom end, the channel has a first width; and a nose positioned at the bottom end of the channel and forming a second width, the second width being less than the first width;

a ball carried and sealed within the channel between the top end and the bottom end of the elongated body of the first plug such that the ball is configured to be launched with the first plug from a surface and is protected from fluid flow, the ball having a circumference, wherein the circumference is less than the first width and greater than the second width;

wherein the ball is configured to travel through the channel of the first plug and rests within proximity to the nose.

2. The system of claim 1, further comprising:

a dissolvable ball configured to be pumped into the elongated housing to rest within a ball seat of the elongated housing.

3. The system of claim 1, further comprising:

a second plug seat; and a second plug configured to engage with the second plug seat.

4. A wellbore system, comprising:

an elongated housing extending from a first end to a second end and having a guide nose engaged with the second end;

a first plug seat having a first latch;

a first plug having a first elongated body and a first nose positioned at an end of the elongated body, the first nose having protrusions configured to engage with the first latch, the first plug having a ball sealed within an elongated channel of the first plug such that the ball is configured to be launched with the first plug from a surface and is protected from fluid flow;

a second plug seat having a second latch; and a second plug having a second elongated body and a second nose positioned at an end of the second elongated body, the second nose having protrusions configured to engage with the second latch;

wherein the first plug and the second plug latch independently within the elongated housing.

* * * * *